US009430971B2

(12) United States Patent
Tsukamoto et al.

(10) Patent No.: US 9,430,971 B2
(45) Date of Patent: Aug. 30, 2016

(54) ELECTRO-OPTICAL UNIT WITH PIXEL CIRCUIT OF REDUCED AREA

(75) Inventors: Kouzi Tsukamoto, Fukuoka (JP); Kazuhiro Takeda, Fukuoka (JP); Takamitsu Urakawa, Fukuoka (JP); Naoki Andou, Kanagawa (JP); Kazutoshi Ono, Fukuoka (JP)

(73) Assignee: SONY CORPORATION, Tokyo (JP)

( * ) Notice: Subject to any disclaimer, the term of this patent is extended or adjusted under 35 U.S.C. 154(b) by 241 days.

(21) Appl. No.: 13/606,876

(22) Filed: Sep. 7, 2012

(65) Prior Publication Data

US 2013/0076725 A1 Mar. 28, 2013

(30) Foreign Application Priority Data

Sep. 22, 2011 (JP) ..... 2011-207985

(51) Int. Cl.
*G09G 3/34* (2006.01)
*G09G 3/36* (2006.01)

(52) U.S. Cl.
CPC ..... *G09G 3/3413* (2013.01); *G09G 3/3614* (2013.01); *G09G 2300/0426* (2013.01); *G09G 2300/0833* (2013.01); *G09G 2300/0838* (2013.01); *G09G 2300/0857* (2013.01); *G09G 2320/0247* (2013.01)

(58) Field of Classification Search
CPC ..... G09G 3/3659; G09G 3/3614; G09G 2300/0857
See application file for complete search history.

(56) References Cited

U.S. PATENT DOCUMENTS

2008/0238850 A1* 10/2008 Watanabe ..... 345/90
2010/0109990 A1* 5/2010 Harada ..... 345/87
2010/0301419 A1* 12/2010 Anderson et al. ..... 257/368
2011/0278677 A1* 11/2011 Otsuki et al. ..... 257/369

FOREIGN PATENT DOCUMENTS

JP 2006-079118 3/2006
JP 2007-094262 4/2007
JP 2007-102167 4/2007
JP 2007-147963 6/2007
JP 2007147963 A * 6/2007
JP 2008-241832 10/2008

OTHER PUBLICATIONS

Japanese Patent Office Action corresponding to Japanese Serial No. 2011207985 dated Jun. 30, 2015.

* cited by examiner

*Primary Examiner* — Gerald Johnson
*Assistant Examiner* — Maheen Javed
(74) *Attorney, Agent, or Firm* — Dentons US LLP

(57) ABSTRACT

An electro-optical unit includes pixels provided correspondingly to portions where a plurality of pairs of data lines and a plurality of gate lines intersect with each other. Each of the pixels has an electro-optical device and a pixel circuit. The pixel circuit has a holding circuit connected with one of the plurality of pairs of data lines and one of the plurality of gate lines, and a selection circuit connected with an output of the holding circuit and the electro-optical device. The holding circuit is capable of sampling and holding a first image signal to be applied to one of the pair of the data lines, while sampling and holding a second image signal to be applied to the other of the pair of the data lines. The selection circuit is capable of outputting the first image signal and the second image signal to the electro-optical device selectively.

12 Claims, 8 Drawing Sheets

| | SHARING OF SOURCES AND DRAINS | NUMBER OF TRANSISTORS | NUMBER OF SOURCES AND DRAINS |
|---|---|---|---|
| TYPICAL PIXEL CIRCUIT ACCORDING TO COMPARATIVE EXAMPLE | × | 12 | 24 |
| PIXEL CIRCUIT ACCORDING TO PRESENT EMBODIMENT | × | 10 | 20 |
| | ○ | 10 | 11 |

FIG. 7

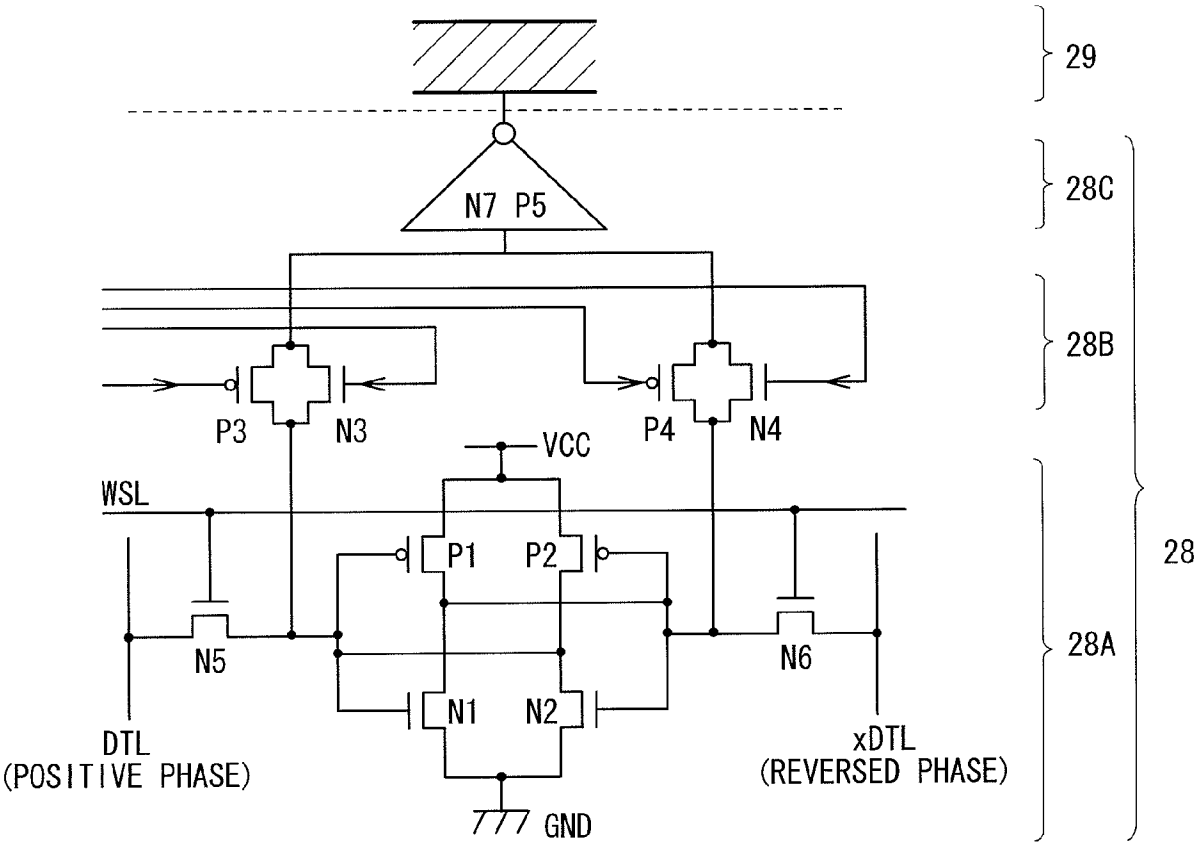
FIG. 8 - COMPARATIVE EXAMPLE

ELECTRO-OPTICAL UNIT WITH PIXEL CIRCUIT OF REDUCED AREA

BACKGROUND

The present technology relates to an electro-optical unit with two data lines assigned for each pixel, and a display including such a unit.

In recent years, a projector that projects an image on a screen has been used widely at home as well as in the office. A projector generates image light by modulating light emitted from a light source with a light valve to project the resultant light on a screen for display. A light valve, which is composed of a liquid crystal panel, modulates light in such a manner that each pixel is subject to an active matrix driving depending on an external image signal (for example, see Japanese Unexamined Patent Application Publication No. 2006-079118).

SUMMARY

With a widespread use of a projector at home, the development of a smaller-sized and higher-definition projector has been advanced. As a result, a pixel circuit included in each pixel has been running out of space for sufficiently assuring a capacitance of a capacitor. To facilitate further higher definition, therefore, a liquid crystal device is driven in a digital driving method that eliminates the need for a large capacitor.

In the digital driving method, each frame of an image signal is composed of a plurality of sub-frames with different display periods that are in smaller amounts of time than a single frame period, and a single frame is displayed by performing on/off control of each of the sub-frames selectively in sequence. At this time, an inversion drive is sometimes carried out that inverts positive and negative of a voltage to be applied to a liquid crystal at a first half and a second half in each of the sub-frames. This inversion drive intends to suppress any deterioration in liquid crystal materials that is caused by flickering or applied direct-current voltage by canceling direct-current components applied to the liquid crystal.

An example of a simple method to achieve such an inversion drive includes a method in which a set of a selection circuit and a buffer circuit is provided one-by-one in a pixel circuit each for a positive-polarity image signal and a negative-polarity image signal. In this case, when a memory circuit is composed of a static random access memory (SRAM), for example, twelve transistors are necessary for the above-described pixel circuit. As shown in an example in FIG. 8, six transistors (N1, N2, N5, N6, P1, and P2) for a memory circuit 28A, four transistors (N3, N4, P3, and P4) for a selection circuit 28B, and two transistors (N7 and P5) for a buffer circuit 28C are respectively necessary. From a viewpoint of achieving higher definition, however, it is preferable to reduce the number of transistors as much as possible for decreasing an area of the pixel circuit.

It is desirable to provide an electro-optical unit and a display that allow an area of a pixel circuit to be reduced.

According to an embodiment of the present technology, there is provided an electro-optical unit, including a plurality of pixels provided correspondingly to portions where a plurality of pairs of data lines with two data lines assigned as a pair and a plurality of gate lines intersect with each other. Each of the pixels has an electro-optical device, and a pixel circuit that is connected with the electro-optical device. The pixel circuit has a holding circuit connected with one of the plurality of pairs of data lines and one of the plurality of gate lines, and a selection circuit connected with an output of the holding circuit and the electro-optical device. The holding circuit is configured to be capable of sampling and holding a first image signal to be applied to one of the pair of the data lines depending on a writing selection signal to be applied to the gate line, while sampling and holding a second image signal to be applied to the other of the pair of the data lines depending on a writing selection signal to be applied to the gate line. The selection circuit is configured to be capable of outputting the first image signal and the second image signal that are held by the holding circuit to the electro-optical device selectively depending on an output selection signal.

According to an embodiment of the present technology, there is provided a display including an illumination optical system, an electro-optical unit generating image light by modulating light emitted from the illumination optical system based on an image signal input, and a projection optical system projecting the image light generated by the electro-optical unit. The electro-optical unit includes: a plurality of pixels provided correspondingly to portions where a plurality of pairs of data lines with two data lines assigned as a pair and a plurality of gate lines intersect with each other. Each of the pixels has an electro-optical device, and a pixel circuit that is connected with the electro-optical device. The pixel circuit has a holding circuit connected with one of the plurality of pairs of data lines and one of the plurality of the gate lines, and a selection circuit connected with an output of the holding circuit and the electro-optical device. The holding circuit is configured to be capable of sampling and holding a first image signal to be applied to one of the pair of data lines depending on a writing selection signal to be applied to the gate lines, while sampling and holding a second image signal to be applied to the other of the pair of data lines depending on a writing selection signal to be applied to the gate lines. The selection circuit is configured to be capable of outputting the first image signal and the second image signal that are held by the holding circuit to the electro-optical device selectively depending on an output selection signal.

In the electro-optical unit and the display according to the embodiments of the present technology, the selection circuit is connected with the output of the holding circuit and the electro-optical device. More specifically, no buffer circuit is provided between the output of the selection circuit and the electro-optical device, with the output of the selection circuit and the electro-optical device being directly connected with each other. This reduces the pixel circuit in size by removing a region occupied by a buffer circuit.

In the electro-optical unit and the display according to the embodiments of the present technology, a buffer circuit is omitted, and the output of the selection circuit and the electro-optical device are directly connected with each other, which allows the pixel circuit to be reduced in size by removing a region occupied by a buffer circuit.

It is to be understood that both the foregoing general description and the following detailed description are exemplary, and are intended to provide further explanation of the technology as claimed.

BRIEF DESCRIPTION OF THE DRAWINGS

The accompanying drawings are included to provide a further understanding of the present disclosure, and are incorporated in and constitute a part of this specification.

The drawings illustrate embodiments and, together with the specification, serve to explain the principles of the present technology.

FIG. 7 is a diagram showing differences between a pixel circuit according to the embodiment of the present technology and a typical pixel circuit according to a comparative example.

FIG. 8 is a diagram showing a circuit configuration of a typical pixel according to a comparative example that is shown in FIG. 7.

DETAILED DESCRIPTION

Hereinafter, embodiments of the present technology are described in details with reference to the drawings. It is to be noted that the descriptions are provided in the order given below.

1. Embodiment
2. Modification Example

1. Embodiment

Configuration

Figure 1:
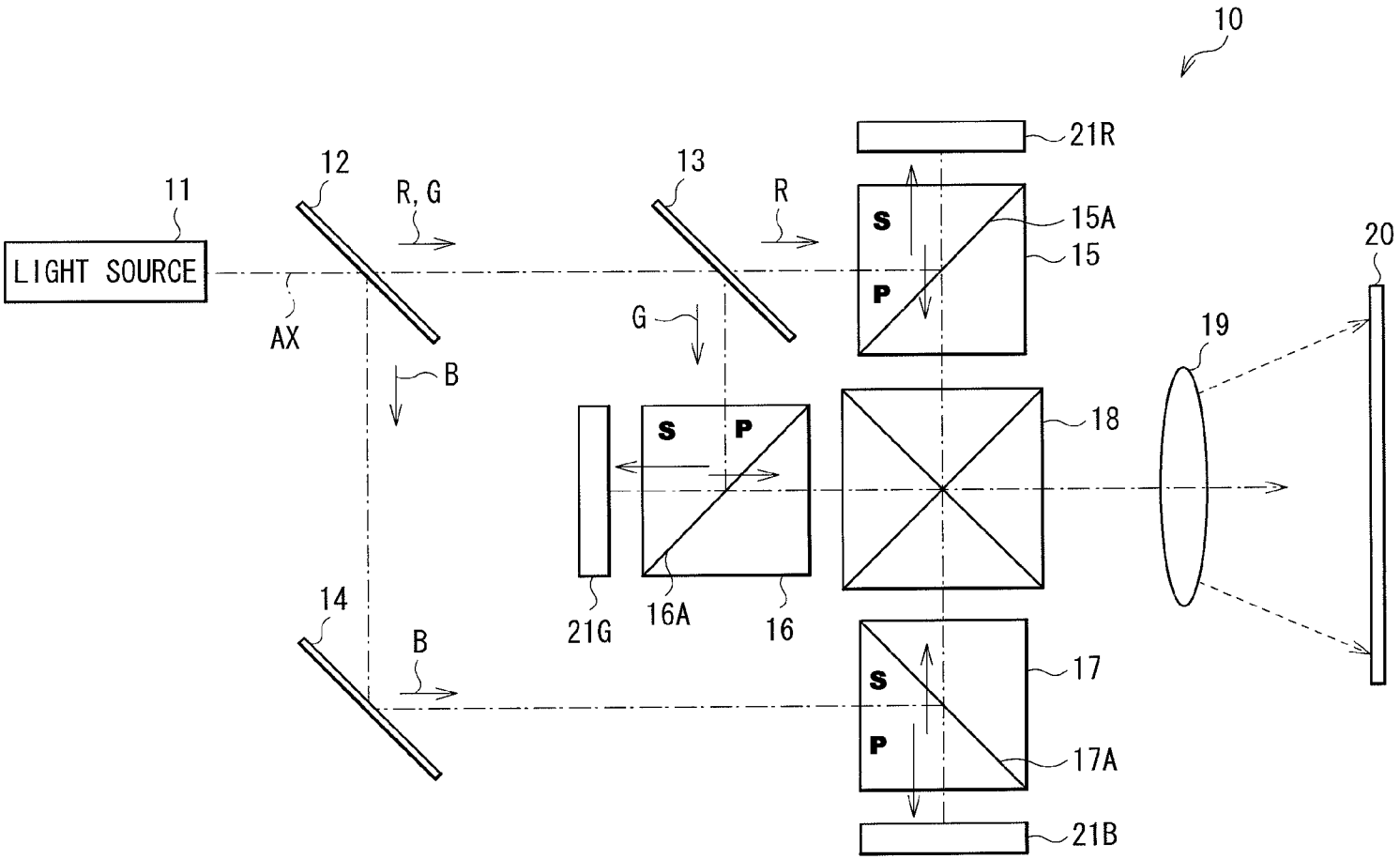
FIG. 1 is a diagram showing an overall configuration of a projection-type display according to an embodiment of the present technology.

FIG. 1 shows an example of an overall configuration for a projection-type display 10 according to an embodiment of the present technology. For example, the projection-type display 10 projects an image displayed on a screen of an information processing unit (not shown in the figure) onto a screen 20. The projection-type display 10 is a reflection mode liquid crystal projector using a reflection mode liquid crystal panel as a light valve. The projection-type display 10 employs a so-called three-plate method to display color images using three liquid crystal light valves 21R, 21G, and 21B each for red, green, and blue colors for example. The projection-type display 10 includes, for example, a light source 11, dichroic mirrors 12 and 13, and a total reflection mirror 14. Further, the projection-type display 10 also includes, for example, polarizing beam splitters 15, 16, and 17, a synthetic prism 18, and a projection lens 19.

It is to be noted that an optical system that is composed of the light source 11, the dichroic mirrors 12 and 13, the total reflection mirror 14, the polarizing beam splitters 15, 16, and 17, as well as the synthetic prism 18 corresponds to a specific but not limitative example of "illumination optical system". Further, the projection lens 19 corresponds to a specific but not limitative example of "projection optical system".

The light source 11, which emits white light including red light, blue light, and green light that are necessary for a color image display, is composed of a halogen lamp, a metal halide lamp, or a xenon lamp for example. The dichroic mirror 12, being disposed on an optical path AX of the light source 11, has a function to split light from the light source 11 into blue light B and the rest of color light (red light R and green light G). The dichroic mirror 13, being disposed on the optical path AX of the light source 11, has a function to split light passing through the dichroic mirror 12 into the red light R and the green light G. The total reflection mirror 14, being disposed on an optical path of light reflected by the dichroic mirror 12, reflects the blue light B split by the dichroic mirror 12 toward the polarizing beam splitter 17.

The polarizing beam splitter 15, being disposed on an optical path of the red light R, has a function to split the incoming red light R into two polarized components that are orthogonal to each other on a polarization split plane 15A. The polarizing beam splitter 16, being disposed on an optical path of the green light G, has a function to split the incoming green light G into two polarized components that are orthogonal to each other on a polarization split plane 16A. The polarizing beam splitter 17, being disposed on an optical path of the blue light B, has a function to split the incoming blue light B into two polarized components that are orthogonal to each other on a polarization split plane 17A. The polarization split plane 15A, 16A, and 17A reflect one polarized component (for example, S polarized component), while transmit the other polarized component (for example, P polarized component) therethrough.

The liquid crystal light valves 21R, 21G, and 21B, which are configured to include a reflection mode liquid crystal panel, generate image light of each color by modulating incoming light based on an input image signal. It is to be noted that the configuration of the liquid crystal light valves 21R, 21G, and 21B is hereinafter described in details. The liquid crystal light valve 21R is disposed on an optical path of the red light R that is reflected on the polarization split plane 15A. The liquid crystal light valve 21R has a function to modulate incoming light through driving by a digital signal that is pulse-width modulated (PWM) depending on, for example, a red image signal, while reflecting the modulated light toward the polarizing beam splitter 15. The liquid crystal light valve 21G is disposed on an optical path of the green light G that is reflected on the polarization split plane 16A. The liquid crystal light valve 21G has a function to modulate incoming light through driving by a digital signal that is pulse-width modulated (PWM) depending on, for example, a green image signal, while reflecting the modulated light toward the polarizing beam splitter 16. The liquid crystal light valve 21B is disposed on an optical path of the blue light B that is reflected on the polarization split plane 17A. The liquid crystal light valve 21B has a function to modulate incoming light through driving by a digital signal that is pulse-width modulated (PWM) depending on, for example, a blue image signal, while reflecting the modulated light toward the polarizing beam splitter 17.

The synthetic prism 18 is disposed at a position where an optical path of each modulated light that is emitted from the liquid crystal light valves 21R, 21G, and 21B to be transmitted through the polarizing beam splitters 15, 16, and 17 intersects with one another. The synthetic prism 18 has a function to synthesize modulated light to generate color image light. The projection lens 19, being disposed on an optical path of image light emitted from the synthetic prism 18, has a function to project the image light emitted from the synthetic prism 18 toward the screen 20.

Figure 2:
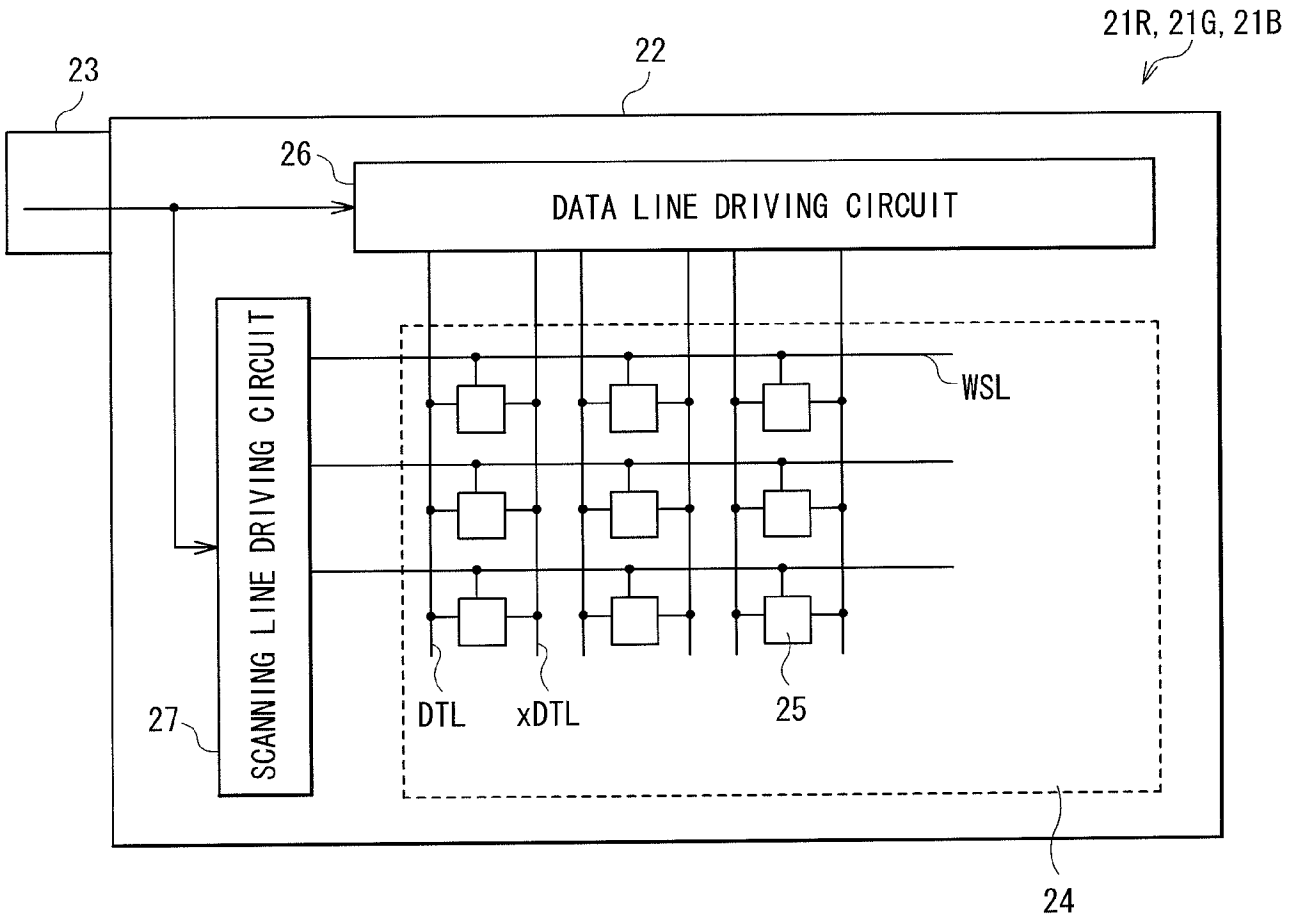
FIG. 2 is a diagram showing a schematic configuration of a liquid crystal light valve illustrated in FIG. 1.

FIG. 2 shows an example of an overall configuration for the liquid crystal light valves 21R, 21G, and 21B illustrated in FIG. 1. Each of the liquid crystal light valves 21R, 21G, and 21B has, for example, a panel section 22 and a flexible printed circuit (FPC) 23 (hereinafter referred to as an FPC 23) that is connected with the panel section 22. The panel section 22 has, for example, a pixel region 24 where a plurality of pixels 25 are formed in a matrix pattern, a data line driving circuit 26, and a scanning line driving circuit 27. The panel section 22 displays an image based on an external digital signal input in such a manner that each of the pixels 25 is actively driven by the data line driving circuit 26 and the scanning line driving circuit 27.

The panel section 22 has a plurality of data lines with two data lines DTL and xDTL extending in a column direction assigned as a pair, and a plurality of gate lines WSL extending in a row direction. It is to be noted that the panel section 22 corresponds to a specific but not limitative example of an "electro-optical unit". The pixel 25 is provided correspondingly to a portion where a pair of the data lines DTL and xDTL and the gate line WSL intersect with each other. The pair of the data lines DTL and xDTL are connected with an output end (not shown in the figure) of the data line driving circuit 26. Each of the gate lines WSL is connected with an output end (not shown in the figure) of the scanning line driving circuit 27.

The data line driving circuit 26, for example, provides digital signals for a single horizontal line that are delivered externally (positive polarity-side digital signals and negative polarity-side digital signals) to each of the pixels 25 as signal voltages. In concrete terms, the data line driving circuit 26, for example, provides each of the positive polarity-side digital signals for a single horizontal line to each of the pixels 25 composing a single horizontal line selected by the scanning line driving circuit 27 through the data lines DTL. Further, the data line driving circuit 26, for example, provides each of the negative polarity-side digital signals for a single horizontal line to each of the pixels 25 composing a single horizontal line selected by the scanning line driving circuit 27 through the data lines xDTL.

The scanning line driving circuit 27, for example, has a function to select the pixels 25 to be driven depending on a scanning timing control signal that is provided externally. More specifically, for example, the scanning line driving circuit 27 selects a row of the pixels 25 that are formed in a matrix pattern as a drive target by applying selection pulses to a selection circuit (not shown in the figure) of the pixels 25 through the scanning lines WSL. Subsequently, on these pixels 25, a display of a single horizontal line is carried out depending on signal voltages provided from the data line driving circuit 26. In such a manner, the scanning line driving circuit 27, for example, scans horizontal lines one by one sequentially in a time-divisional manner to perform a display over the whole pixel region.

Figure 3:
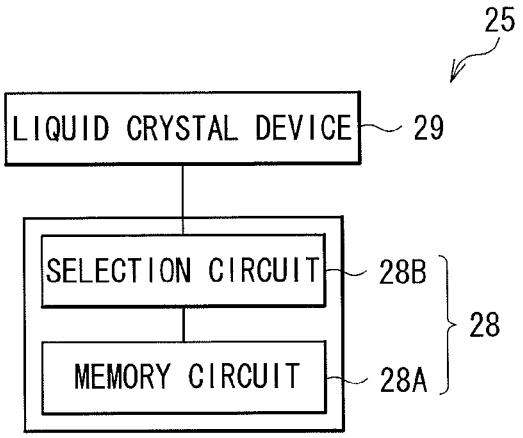
FIG. 3 is a diagram showing functional blocks of a pixel illustrated in FIG. 2.

Next, a circuit configuration of the pixel 25 is described. As shown in FIG. 3, the pixel 25 has a liquid crystal device 29, and a pixel circuit 28 that is connected with the liquid crystal device 29. The pixel circuit 28 has a memory circuit 28A, and a selection circuit 28B that is connected with an output of the memory circuit 28A and the liquid crystal device 29. The pixel circuit 28 has no buffer circuit between an output of the selection circuit 28B and the liquid crystal device 29. Therefore, a capacitive load of the liquid crystal device 29 is seen from the pixel circuit 28. However, the liquid crystal device 29 is configured to keep a capacitive load of the liquid crystal device 29 when seen from the pixel circuit 28 in a size that prevents information (for example, "1" or "0" information) of a sampling signal held in the memory circuit 28A from being destroyed. As a result, the present embodiment eliminates the necessity for the above-described buffer circuit.

Figure 4:
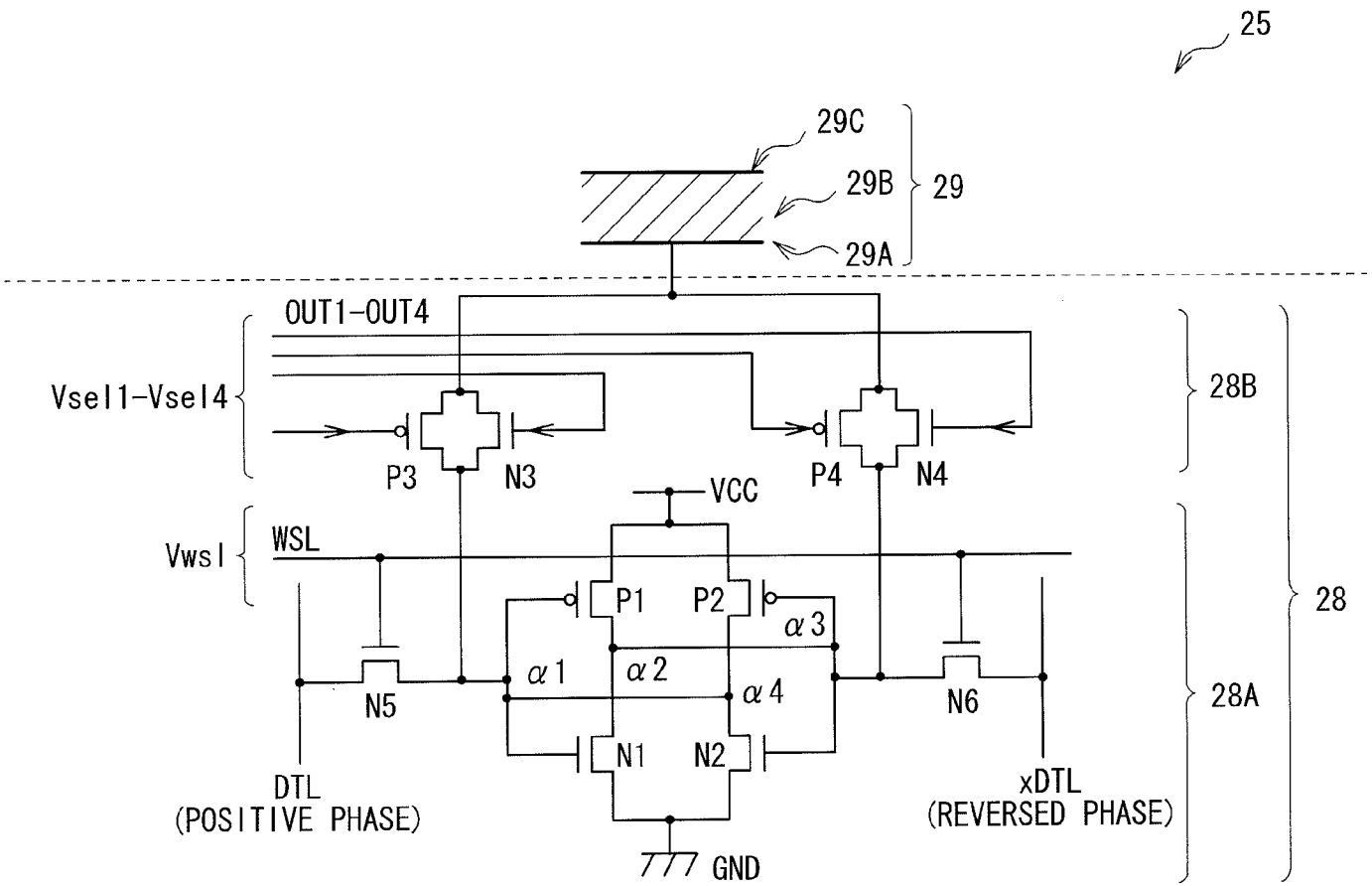
FIG. 4 is a diagram showing a circuit configuration of the pixel illustrated in FIG. 3.

FIG. 4 shows an example of the memory circuit 28A and the selection circuit 28B, as well as a schematic configuration of the liquid crystal device 29. The memory circuit 28A is connected with the pair of data lines DTL and xDTL, and the gate line WSL. The memory circuit 28A is configured to be capable of sampling and holding a positive polarity image signal (first image signal) to be applied to the data line DTL depending on a writing selection signal Vws1 to be applied to the gate line WSL, while sampling and holding a negative polarity image signal (second image signal) to be applied to the data line xDTL depending on the writing selection signal Vws1 to be applied to the gate line WSL. The memory circuit 28A has, for example, an n-channel type (first-channel type) transistor N5 that samples a positive polarity image signal depending on the writing selection signal Vws1, and an n-channel type transistor N6 that samples a negative polarity image signal depending on the writing selection signal Vws1. Further, the memory circuit 28A also has, for example, an SRAM to hold a sampling signal that is sampled by the transistor N5 and the transistor N6.

As shown in an example in FIG. 4, the memory circuit 28A is configured to include the SRAM, and has a configuration of two complementary metal oxide semiconductor (CMOS) inverters facing each other. One CMOS inverter is connected with the data line DTL through the n-channel type transistor N5. This CMOS inverter is configured in such a manner that a serial connection of a source or a drain of a p-channel type (second-channel type) transistor P1 with a source or a drain of an n-channel type transistor N1 is inserted in series between a power supply line VCC and a ground line GND. The source or the drain of the transistor P1 is connected with the power supply line VCC side, while the source or the drain of the transistor N1 is connected with the ground line GND side. Further, gate electrodes of the transistors P1 and N1 are connected with each other. It is to be noted that a connection point between a gate of the transistor P1 and a gate of the transistor N1 is referred to as $\alpha$1. Additionally, a connection point between the source or the drain of the transistor P1 and the source or the drain of the transistor N1 is referred to as $\alpha$2.

The other CMOS inverter is connected with the data line xDTL through the n-channel type transistor N6. This CMOS inverter is configured in such a manner that a serial connection of a source or a drain of a p-channel type transistor P2 with a source or a drain of an n-channel type transistor N2 is inserted in series between the power supply line VCC and the ground line GND. The source or the drain of the transistor P2 is connected with the power supply line VCC side, while the source or the drain of the transistor N2 is connected with the ground line GND side. Further, gate electrodes of the transistors P2 and N2 are connected with each other. It is to be noted that a connection point between a gate of the transistor P2 and a gate of the transistor N2 is referred to as $\alpha$3. Additionally, a connection point between the source or the drain of the transistor P2 and the source or the drain of the transistor N2 is referred to as $\alpha$4.

Further, a source and a drain of the n-channel type transistor N5 are separately connected with the data line DTL and the connection point $\alpha$1 respectively, while a gate of the transistor N5 is connected with the gate line WSL. On the other hand, a source and a drain of the n-channel type transistor N6 are separately connected with the data line xDTL and the connection point $\alpha$3 respectively, while a gate of the transistor N6 is connected with the gate line WSL.

The selection circuit 28B is configured to be capable of outputting a positive polarity image signal (first image signal) and a negative polarity image signal (second image signal) that are stored in the memory circuit 28A to the liquid crystal device 29 selectively depending on output selection signals Vsel1 to Vsel4. The selection circuit 28B has a pair of a p-channel type transistor P3 and an n-channel type transistor N3 that output a sampling signal of the positive polarity image signal stored in the memory circuit 28A (SRAM) to the liquid crystal device 29 depending on the output selection signals Vsel1 to Vsel4. Further, the selection circuit 28B has a pair of a p-channel type transistor P4 and an n-channel type transistor N4 that output a sampling signal of the negative polarity image signal stored in the memory circuit 28A (SRAM) to the liquid crystal device 29 depending on the output selection signals Vsel1 to Vsel4.

A source of the transistor P3 and a source of the transistor N3 are connected with each other, while a drain of the transistor P3 and a drain of the transistor N3 are connected with each other. Further, a source of the transistor P4 and a source of the transistor N4 are connected with each other, while a drain of the transistor P4 and a drain of the transistor N4 are connected with each other. Sources or drains of the transistors P3 and N3 are connected with the connection point α1, while terminals unconnected with the connection point α1 among the sources and drains of the transistors P3 and N3 are connected with the liquid crystal device 29. On the other hand, sources or drains of the transistors P4 and N4 are connected with the connection point α3, while terminals unconnected with the connection point α3 among the sources and drains of the transistors P4 and N4 are connected with the liquid crystal device 29.

The liquid crystal device 29 is composed of, for example, a reflective electrode 29A, a liquid crystal layer 29B, and a transparent electrode 29C that are laminated from the opposite side of a light incident plane of the liquid crystal device 29. The reflective electrode 29A reflects light incoming into the liquid crystal device 29, while functioning as a pixel electrode for each of the pixels 25. The transparent electrode 29C functions as an electrode in common to each of the pixels 25.

Figure 5:
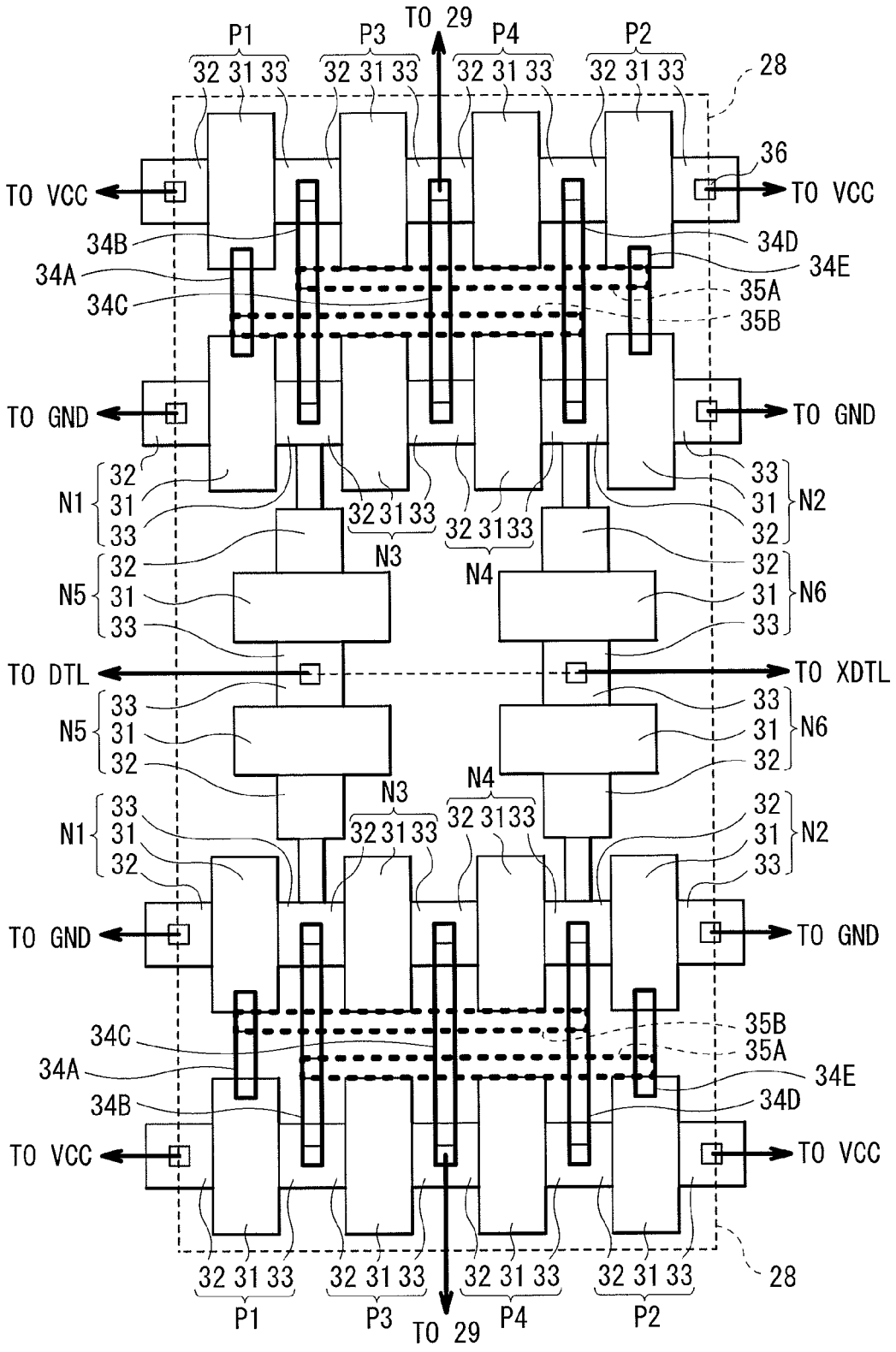
FIG. 5 is a diagram showing a layout example of the pixel illustrated in FIG. 4.

Next, a layout of the pixel circuit 28 is described. FIG. 5 shows an example of a layout for the pixel circuit 28. It is to be noted that although FIG. 5 shows only two pixel circuits 28 that are adjacent to each other in a column direction, in reality, next to these pixel circuits 28, a plurality of the pixel circuits 28 having the same configuration as these pixel circuits 28 are formed consecutively in a horizontal direction (row direction) of FIG. 5.

The pixel circuit 28 has a plurality of p-channel type transistors P1 to P4, and a plurality of n-channel type transistors N1 to N6. Each of the transistors P1 to P4 and the transistors N1 to N6 has a gate 31, as well as a source 32 and a drain 33 that are facing to each other with the gate 31 interposed between. It is to be noted that the source 32 and the drain 33 correspond to a specific but not limitative example of "a pair of source-drain region". The transistors P1 to P4 are disposed in a row direction in the order corresponding to the transistors P1, P3, P4, and P2 for example. The transistors N1 to N4 are disposed in a row direction in the order corresponding to the transistors N1, N3, N4, and N2 for example.

On the transistors P1 to P4, either the source 32 or the drain 33 is shared (used in common) in the transistors that are adjacent to each other. Here, the sharing (common use) means that a diffusing region composing the source or the drain of one transistor is also a diffusing region composing the source or the drain of the other transistor as well. In other words, the sharing (common use) means that a single contact electrode in ohmic contact with a single diffusing region that is usable as the source or the drain becomes a source electrode or a drain electrode for two transistors.

It is to be noted that, in some instances, the sources 32 and the drains 33 may be formed separately in the transistors that are adjacent to each other (not shown in the figure). On the transistors N1 to N4, either the source 32 or the drain 33 is shared (used in common) in the transistors that are adjacent to each other. It is to be noted that, in some instances, the sources 32 and the drains 33 may be formed separately in the transistors that are adjacent to each other (not shown in the figure).

On the transistors N5 and N6, the sources 32 and the drains 33 are disposed to be placed in opposition to a direction intersecting with an arrangement direction of the sources 32 and the drains 33 of the transistors N1 to N4. Further, on the transistors N5 and N6, the sources 32 or the drains 33 in proximity to the transistors N1 to N4 are electrically connected with the sources 32 or the drains 33 of the transistors N1 to N4. In concrete terms, on the transistor N5, the source 32 is electrically connected with the drain 33 of the transistor N1. Further, on the transistor N6, the source 32 is electrically connected with the source 32 of the transistor N2.

On the transistors P1 to P4, the sources 32 and the drains 33 are disposed in a line (on a line in a row direction in the figure), and on the transistors N1 to N4 as well, the sources 32 and the drains 33 are disposed in a line (on a line in a row direction in the figure). An arrangement direction of the sources 32 and the drains 33 on the transistors P1 to P4 and an arrangement direction of the sources 32 and the drains 33 on the transistors N1 to N4 are in parallel with each other. On the transistors P1 to P4, a portion corresponding to an end of the pixel circuit 28 among the sources 32 and the drains 33 that are disposed in a line is shared (used in common) with sources and drains of p-channel type transistors in other pixel circuit 28 in abutment with the relevant pixel circuit 28. Further, on the transistors N1 to N4, a portion corresponding to an end of the pixel circuit 28 among the sources 32 and the drains 33 that are disposed in a line is shared (used in common) with sources and drains of n-channel type transistors in other pixel circuit 28 in abutment with the relevant pixel circuit 28. Additionally, on the transistors N5 and N6, either the sources 32 or the drains 33 that are unconnected with the transistors N1 to N4 are shared (used in common) with sources or drains of n-channel type transistors in other pixel circuit 28 in abutment with the relevant pixel circuit 28.

It is to be noted that, in some instances, on the transistors P1 to P4, a portion corresponding to an end of the pixel circuit 28 among the sources 32 and the drains 33 that are disposed in a line may be formed separately from sources and drains of p-channel type transistors in other pixel circuit 28 in abutment with the relevant pixel circuit 28. Further, in some instances, on the transistors N1 to N4, a portion corresponding to an end of the pixel circuit 28 among the sources 32 and the drains 33 that are disposed in a line may be formed separately from sources or drains of n-channel type transistors in other pixel circuit 28 in abutment with the relevant pixel circuit 28. Additionally, in some instances, on the transistors N5 and N6, either the sources 32 or the drains 33 that are unconnected with the transistors N1 to N4 may be formed separately from sources or drains of n-channel type transistors in other pixel circuit 28 in abutment with the relevant pixel circuit 28.

A contact 36 extending in a laminating direction is provided one-by-one on each of the sources 32 and each of the drains 33. The contact 36 has a role to make electrical connections of wires 34A to 34E, 35A, and 35B to be hereinafter described with the sources 32 or the drains 33.

Further, the contact 36 also has a role to make electrical connections of the sources 32 or the drains 33 with the data line DTL, the data line xDTL, the power supply line VCC, the ground line GND, or the liquid crystal device 29 (see thick arrows in FIG. 5).

Gates 31 of the transistor P1 and the transistor N1 are electrically connected through the wire 34A. Similarly, gates 31 of the transistor P2 and the transistor N2 are electrically connected through the wire 34E. Further, the drain 33 of the transistor P1 (or the source 32 of the transistor P3) and the drain 33 of the transistor N1 (or the source 32 of the transistor N3) are electrically connected through the wire 34B. Similarly, the drain 33 of the transistor P3 (or the source 32 of the transistor P4) and the drain 33 of the transistor N3 (or the source 32 of the transistor N4) are electrically connected through the wire 34C. Further, the drain 33 of the transistor P4 (or the source 32 of the transistor P2) and the drain 33 of the transistor N4 (or the source 32 of the transistor N2) are electrically connected through the wire 34D. Additionally, the wire 34A and the wire 34D are electrically connected through the wire 35B. Moreover, the wire 34B and the wire 34E are electrically connected through the wire 35A.

Figure 6:
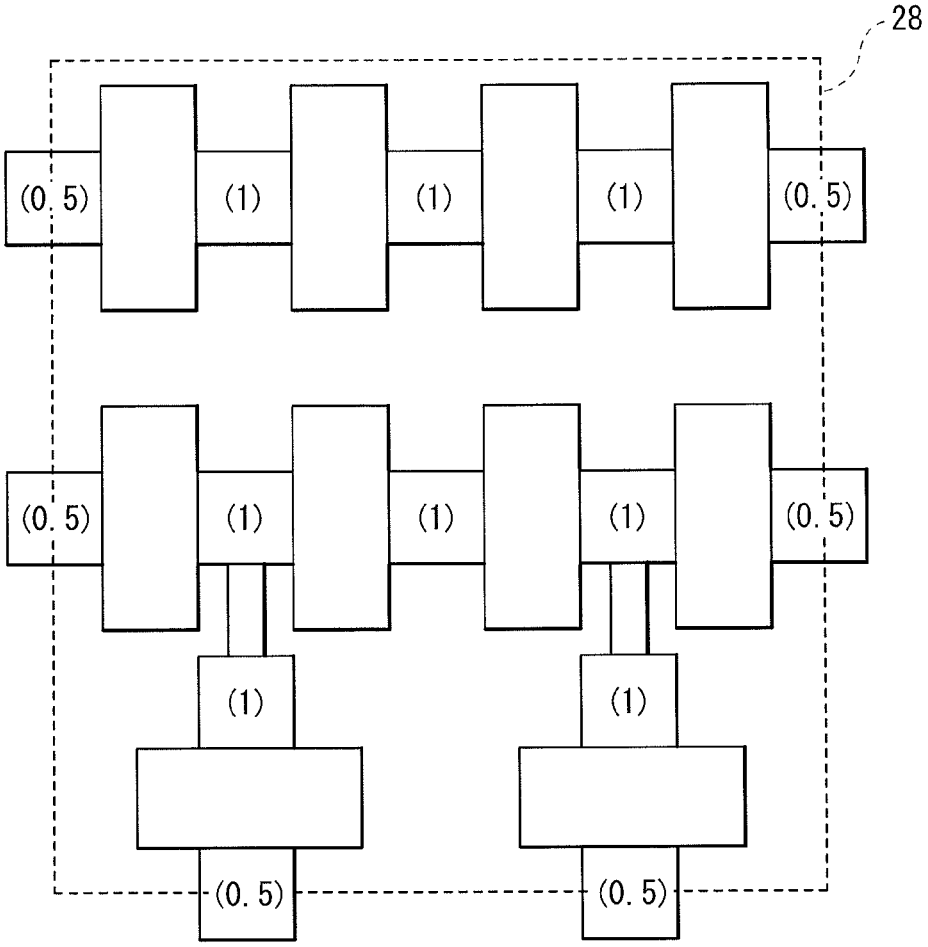
FIG. 6 is a diagram extracting only a gate, a source, and a drain from the pixel illustrated in FIG. 5.

FIG. 6 extracts only the gates 31, the sources 32, and the drains 33 from the pixel circuit 28 illustrated in FIG. 5. It is to be noted that, in FIG. 6, signs of the gates 31, the sources 32, and the drains 33 are omitted, and values of areas of the sources 32 and the drains 33 are denoted instead. For example, (1) in the figure means that one piece of the source 32 or the drain 33 is located at a position designated as (1) in the figure. Further, for example, (0.5) in the figure means that 0.5 piece of the source 32 or the drain 33 is located at a position designated as (0.5) in the figure. Here, 0.5 piece means that the source 32 or the drain 33 is shared by two pixel circuits 28 at the corresponding position, which is half of the normal area of the source 32 or the drain 33 in size.

FIG. 7 illustrates comparison of features of the pixel circuit 28 according to the present embodiment and a typical pixel circuit according to a comparative example. As shown in FIG. 8, a typical pixel circuit according to a comparative example differs from the pixel circuit 28 according to the present embodiment in that a buffer circuit 28C is provided in the pixel circuit 28. It is to be noted that FIG. 7 shows a result in case where the sources 32 and the drains 33 are shared (used in common) and a result in case where the sources 32 and the drains 33 are formed separately from each other, in the pixel circuit 28 according to the present embodiment.

The pixel circuit 28 according to the present embodiment removes the buffer circuit 28C that is provided in a typical pixel circuit according to a comparative example, resulting in the number of transistors being reduced (by two) accordingly. Further, when the sources 32 and the drains 33 are not shared (not used in common) in the pixel circuit 28 according to the present embodiment, the number of the sources and drains is reduced (by four) accordingly because the buffer circuit 28C that is provided in a typical pixel circuit according to a comparative example is omitted. Additionally, when the sources 32 and the drains 33 are shared (used in common) in the pixel circuit 28 according to the present embodiment, the number of the sources and drains is eleven which is equivalent to a total of the numerical values shown in FIG. 6. This number is smaller than half of the number of the sources and drains in a typical pixel circuit according to a comparative example. In other words, when the sources 32 and the drains 33 are shared (used in common) in the pixel circuit 28 according to the present embodiment, the area of the pixel circuit 28 is smaller than half the area of a typical pixel circuit according to a comparative example.

[Operation]

Next, the description is provided on an operation of the projection-type display 10 according to the embodiment of the present technology. In the projection-type display 10 according to the present embodiment, white light emitted from the light source 11 is first split into the blue light B and the rest of color light (red light R and green light G) by the dichroic mirror 12. The blue light B is reflected toward the polarizing beam splitter 17 by the total reflection mirror 14. On the other hand, the red light R and green light G are further split into the red light R and green light G by the dichroic mirror 13. The split red light R is incident into the polarizing beam splitter 15, while the split green light G is incident into the polarizing beam splitter 16.

In the polarizing beam splitters 15, 16, and 17, each of the incident color light is split into two polarized components that are orthogonal to each other on the polarization split planes 15A, 16A, and 17A. At this time, one polarized component (for example, S polarized component) is reflected toward the liquid crystal light valves 21R, 21G, and 21B. At this moment, since each of the liquid crystal light valves 21R, 21G, and 21B is driven by a digital signal that is pulse-width modulated (PWM), depending on the image signal of each color, each polarized light is modulated for each of the pixels 25, and the modulated light is transmitted through the polarizing beam splitters 15, 16, and 17 to come into the synthetic prism 18. The modulated light is synthesized on the synthetic prism 18, and the resulting color image light is projected on the screen 20 by the projection lens 19. In such a manner, a color image is displayed on the screen 20.

[Advantageous Effects]

Next, the description is provided on advantageous effects of the projection-type display 10 according to the embodiment of the present technology. In the present embodiment, the selection circuit 28B is connected with the output of the memory circuit 28A and the liquid crystal device 29. In other words, no buffer circuit is provided between the output of the selection circuit 28B and the liquid crystal device 29, with the output of the selection circuit 28B and the liquid crystal device 29 being directly connected with each other. This allows the pixel circuit 28 to be reduced in size by removing a region occupied by a buffer circuit. Further, it is also possible to reduce the number of transistors by removing transistors in a buffer circuit.

Further, in the present embodiment, it is desirable that the sources or the drains or both be used in common on the transistors P1 to P4 that are in abutment with each other, and either the sources or the drains be used in common on the second transistors that are in abutment with each other. Common use of the sources or the drains in such a manner allows the pixel circuit to be reduced in size by removing a region occupied by the sources or the drains.

2. Modification Example

In the above-described embodiment of the present technology, the memory circuit 28A may be composed of any memory circuit other than the SRAM. Further, although each pixel 28 has the liquid crystal device 29, each pixel 28 may have any electro-optical device other than the liquid crystal device 29 as an alternative to the liquid crystal device 29.

Moreover, for example, the present technology may be configured as follows.

(1) An electro-optical unit, including a plurality of pixels provided correspondingly to portions where a plurality of pairs of data lines with two data lines assigned as a pair and a plurality of gate lines intersect with each other, wherein each of the pixels has an electro-optical device, and a pixel circuit that is connected with the electro-optical device, the pixel circuit has a holding circuit connected with one of the plurality of pairs of data lines and one of the plurality of gate lines, and a selection circuit connected with an output of the holding circuit and the electro-optical device, the holding circuit is configured to be capable of sampling and holding a first image signal to be applied to one of the pair of the data lines depending on a writing selection signal to be applied to the gate line, while sampling and holding a second image signal to be applied to the other of the pair of the data lines depending on a writing selection signal to be applied to the gate line, and the selection circuit is configured to be capable of outputting the first image signal and the second image signal that are held by the holding circuit to the electro-optical device selectively depending on an output selection signal.

(2) The electro-optical unit according to (1), wherein an output of the selection circuit is directly connected with the electro-optical device.

(3) The electro-optical unit according to (1) or (2), wherein the electro-optical device is configured to keep a capacitive load of the electro-optical device when seen from the pixel circuit in a size that prevents information of a sampling signal held in the holding circuit from being destroyed.

(4) The electro-optical unit according to any one of (1) to (3), wherein the holding circuit includes a transistor sampling the first image signal depending on the writing selection signal, a transistor sampling the second image signal depending on the writing selection signal, and a static random access memory (SRAM) holding a sampling signal of the first image signal and the second image signal, and the selection circuit includes a pair of transistors outputting the sampling signal of the first image signal that is held in the SRAM to the electro-optical device depending on the output selection signal, and a pair of transistors outputting the sampling signal of the second image signal that is held in the SRAM to the electro-optical device depending on the output selection signal.

(5) The electro-optical unit according to (4), wherein the SRAM is composed of a plurality of transistors, each of transistors included in the holding circuit and the selection circuit has a gate, and a pair of source and drain regions facing to each other with the gate interposed between, a plurality of transistors included in the holding circuit and the selection circuit are composed of a plurality of first transistors of a first-channel type and a plurality of second transistors of a second-channel type, in the plurality of first transistors included in the SRAM and the selection circuit, the source and drain regions are used in common on the first transistors in abutment with one another, and in the plurality of second transistors included in the SRAM and the selection circuit, the source and drain regions are used in common on the second transistors in abutment with one another.

(6) The electro-optical unit according to (5), wherein the source and drain regions are disposed in a line on the plurality of first transistors, and the source and drain regions are disposed in a line on the plurality of second transistors as well.

(7) The electro-optical unit according to (6), wherein an arrangement direction of the source and drain regions on the plurality of first transistors and an arrangement direction of the source and drain regions on the plurality of second transistors are in parallel with each other.

(8) The electro-optical unit according to any one of (5) to (7), wherein on a plurality of transistors other than the SRAM that are included in the holding circuit, a pair of source and drain regions are disposed to be placed in opposition to a direction intersecting with an arrangement direction of the source and drain regions of the second transistors, and the source and drain regions in proximity to the second transistors are electrically connected with the source and drain regions of the second transistors.

(9) The electro-optical unit according to any one of (5) to (7), wherein on the plurality of first transistors, a source and drain region corresponding to an end of the pixel circuit among a plurality of source and drain regions that are disposed in a line is used in common with a source and drain region included in other pixel circuit in abutment with the relevant pixel circuit.

(10) The electro-optical unit according to (9), wherein on the plurality of second transistors, a source and drain region corresponding to an end of the pixel circuit among a plurality of source and drain regions that are disposed in a line is used in common with a source and drain region included in other pixel circuit in abutment with the relevant pixel circuit.

(11) The electro-optical unit according to (8), wherein on a plurality of transistors other than the SRAM that are included in the holding circuit, a source and drain region that is unconnected with the second transistors is used in common with a source and drain region included in other pixel circuit in abutment with the relevant pixel circuit.

(12) A display including an illumination optical system, an electro-optical unit generating image light by modulating light emitted from the illumination optical system based on an image signal input, and a projection optical system projecting the image light generated by the electro-optical unit, the electro-optical unit including:

a plurality of pixels provided correspondingly to portions where a plurality of pairs of data lines with two data lines assigned as a pair and a plurality of gate lines intersect with each other, wherein each of the pixels has an electro-optical device, and a pixel circuit that is connected with the electro-optical device, the pixel circuit has a holding circuit connected with one of the plurality of pairs of data lines and one of the plurality of the gate lines, and a selection circuit connected with an output of the holding circuit and the electro-optical device, the holding circuit is configured to be capable of sampling and holding a first image signal to be applied to one of the pair of data lines depending on a writing selection signal to be applied to the gate lines, while sampling and holding a second image signal to be applied to the other of the pair of data lines depending on a writing selection signal to be applied to the gate lines, and the selection circuit is configured to be capable of outputting the first image signal and the second image signal that are held by the holding circuit to the electro-optical device selectively depending on an output selection signal.

The present disclosure contains subject matter related to that disclosed in Japanese Priority Patent Application JP 2011-207985 filed in the Japan Patent Office on Sep. 22, 2011, the entire content of which is hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. An electro-optical unit, comprising a pixel corresponding to a portion where first and second data lines intersect a gate line, the pixel including (a) an electro-optical device, and (b) a pixel circuit connected to the electro-optical device, wherein: the pixel circuit has (a) a holding circuit connected to the first and second data lines and the gate line, and (b) a selection circuit connected to the holding circuit and the electro-optical device, the holding circuit is configured to (a) sample a first image signal to be applied to the first data line based on a writing selection signal to be applied to the gate line and hold a first sampling signal of the first image signal via a static random access memory (SRAM), and (b) sample a second image signal to be applied to the second data line based on the writing selection signal to be applied to the gate line and hold a second sampling signal of the second image signal via the SRAM, the selection circuit is configured to (a) receive the first sampling signal of the first image signal from the holding circuit via a first signal line and selectively output the first sampling signal under control of first output selection signals and (b) receive the second sampling signal of the second image signal from the holding circuit via a second signal line and selectively output the second sampling signal under control of second output selection signals, the selection circuit selectively outputting the first and second sampling signals to the electro-optical device, and the first signal line has an end electrically connected between the first data line and the SRAM and the second signal line has an end electrically connected between the second data line and the SRAM.

2. The electro-optical unit according to claim 1, wherein an output of the selection circuit is directly connected with the electro-optical device.

3. The electro-optical unit according to claim 2, wherein the electro-optical device maintains a capacitive load of the electro-optical device at a level that prevents information of the first and second sampling signals held in the holding circuit from being destroyed.

4. The electro-optical unit according to claim 3, wherein:

the holding circuit includes a first sampling transistor sampling the first image signal based on the writing selection signal, a second sampling transistor sampling the second image signal based on the writing selection signal, and the SRAM holding the first and second sampling signals, and the selection circuit includes a first pair of transistors outputting the first sampling signal of the first image signal that is held in the SRAM to the electro-optical device depending on the first output selection signals which are connected to gates of the first pair of transistors, and a second pair of transistors outputting the second sampling signal of the second image signal that is held in the SRAM to the electro-optical device depending on the second output selection signals which are connected to gates of the second pair of transistors.

5. The electro-optical unit according to claim 4, wherein:

the SRAM is composed of a plurality of transistors, each of transistors included in the holding circuit and the selection circuit has a gate and a pair of source and drain regions, a plurality of transistors included in the holding circuit and the selection circuit are composed of a plurality of first transistors of a first-channel type and a plurality of second transistors of a second-channel type, in the plurality of first transistors included in the SRAM and the selection circuit, the source and drain regions are used in common on the first transistors in abutment with one another, and in the plurality of second transistors included in the SRAM and the selection circuit, the source and drain regions are used in common on the second transistors in abutment with one another.

6. The electro-optical unit according to claim 5, wherein:

the source and drain regions of the plurality of first transistors are disposed in a line, and the source and drain regions of the plurality of second transistors are disposed in a line.

7. The electro-optical unit according to claim 6, wherein an arrangement direction of the source and drain regions of the plurality of first transistors and an arrangement direction of the source and drain regions of the plurality of second transistors are parallel to each other.

8. The electro-optical unit according to claim 7, the holding circuit has source and drain regions that are disposed in a direction intersecting with an arrangement direction of the source and drain regions of the plurality of second transistors.

9. The electro-optical unit according to claim 8, wherein the holding circuit has a source region or a drain region that is unconnected with the plurality of second transistors and that is used in common with a source region or a drain region of another pixel circuit in abutment with the pixel circuit.

10. The electro-optical unit according to claim 7, wherein one of the plurality of first transistors has a source region or a drain region at an end of the pixel circuit that is used in common with a source region or a drain region of another pixel circuit that is in abutment with the pixel circuit.

11. The electro-optical unit according to claim 10, wherein one of the plurality of second transistors has a source region or a drain region at an end of the pixel circuit that is used in common with a source region or a drain region of another pixel circuit that is in abutment with the pixel circuit.

12. A display including an illumination optical system, an electro-optical unit generating image light by modulating light emitted from the illumination optical system based on an image signal input, the electro-optical unit comprising a pixel corresponding to a portion where first and second data lines intersect a gate line, and a projection optical system projecting the image light generated by the electro-optical unit, wherein, the pixel includes (a) an electro-optical device, and (b) a pixel circuit connected with the electro-optical device, the pixel circuit has (a) a holding circuit connected to the first and second data lines and the gate line, and (b) a selection circuit connected to the holding circuit and the electro-optical device, the holding circuit is configured to (a) sample a first image signal to be applied to the first data line based on a writing selection signal to be applied to the gate line and hold a first sampling signal of the first image signal via a static random access memory (SRAM), and (b) sample a second image signal to be applied to the second data line based on the writing selection signal to be applied to the gate line and hold a second sampling signal of the second image signal via the SRAM, the selection circuit is configured to (a) receive the first sampling signal of the first image signal from the holding circuit via a first signal line and selectively output the first image signal under control of first output selection signals and (b) receive the second sampling signal of the second image signal from the holding circuit via a second signal line and selectively output the second image signal under control of second output selection signals, the selection circuit selectively outputting the first and second sampling signals to the electro-optical device, and the first signal line has an end electrically connected between the first data line and the SRAM and the second signal line has an end electrically connected between the second data line and the SRAM.

* * * * *